US005368352A

United States Patent [19]

Juhas

[11] Patent Number: 5,368,352

[45] Date of Patent: Nov. 29, 1994

[54] GOLF BALL RETRIEVER

[75] Inventor: Joseph A. Juhas, Litchfield, Conn.

[73] Assignee: Charles B. Pasternak, Milwaukee, Wis.

[21] Appl. No.: 180,054

[22] Filed: Jan. 11, 1994

[51] Int. Cl.[5] ..... A63B 47/02

[52] U.S. Cl. ..... 294/19.2

[58] Field of Search ..... 294/19.1, 19.2; 273/32 D, 32 F, 162 E, 162 F

[56] References Cited

U.S. PATENT DOCUMENTS

| | | | |
|---|---|---|---|
| 1,380,526 | 6/1921 | Carpenter | 294/19.2 X |
| 1,960,110 | 5/1934 | Iles | 294/19.2 X |
| 3,520,569 | 7/1970 | Anderson | 294/19.2 |
| 4,310,189 | 1/1982 | Nihra | 294/19.2 |
| 4,515,402 | 5/1985 | Sedan | 294/19.2 |
| 4,976,436 | 12/1990 | Serizawa | 294/19.2 X |
| 5,188,409 | 2/1993 | Forey | 294/19.2 |

*Primary Examiner*—Johnny D. Cherry

[57] ABSTRACT

The disclosure describes and illustrates a golf ball retriever including a ring secured to a telescopically collapsible handle, the interior surface of the ring having multiple cylindrical surfaces with internal diameters just slightly smaller than the the diameter of the ball to be retrieved. The multiple cylindrical surfaces permit retrieval of standard 1.680 inch diameter golf balls as well as the newly accepted 1.720 inch golf ball.

3 Claims, 1 Drawing Sheet

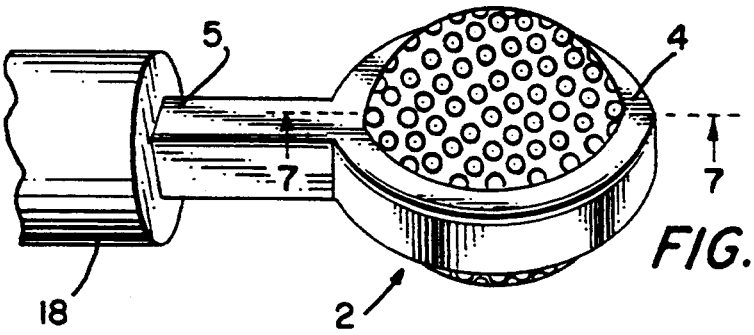
FIG. 1
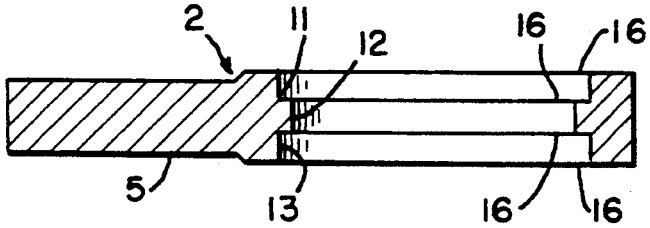
FIG. 2
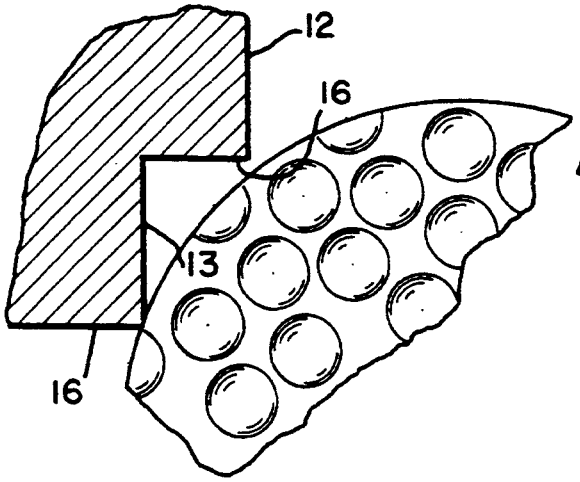
FIG. 4
FIG. 3
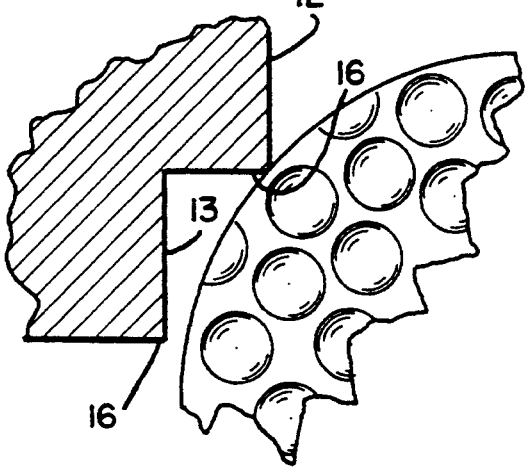

GOLF BALL RETRIEVER

BACKGROUND OF THE INVENTION

This invention relates generally to golf ball retrievers and, more particularly, to golf ball retrievers having a single gripping ring or loop capable of picking up a golf ball.

For many years the United States Golf Association has held that the minimum diameter of regulation golf balls be set at 1.680 inches; there is no limit set for the maximum diameter of golf balls by the USGA. Until recently only golf balls having the minimum diameter set by the USGA were produced. In early 1993 a golf ball was accepted by the USGA as regulation, having a diameter of 1.720 inches. This new ball size limits the usefulness of single loop retrievers, as described in the Nihra U.S. Pat. No. 4,310,189, in that the inside diameter of the retrieval loop is "sized so as to be just barely smaller than the diameter of the standard golf ball". The Forey U.S. Pat. No. 5,188,409 describes a single loop golf ball retriever having "an internal diameter a little less than the diameter of a golf ball" which limits its ability to retrieve golf balls of different diameters.

DISCLOSURE OF THE INVENTION

A general object of the invention is to provide an improved single loop golf ball retriever capable of retrieving golf balls of different diameters.

Another object of the invention is to provide a single loop golf ball retriever capable of retrieving golf balls, having different diameters, using either face of the loop to contact the the ball for retrieval.

A further object of the invention is to provide a single loop golf ball retriever requiring only slight pressure, i.e. equal to the weight of a golf ball, to grip golf balls of different diameters.

Still another object of the invention is to provide a single loop golf ball retriever of such dimensions that it may be slid under a ball resting on mud or a steep incline, when such resting position will not offer sufficient support to allow gripping force to be applied to the top of the ball. These and other objects and advantages of the invention will become more apparent when reference is made to the following drawings and accompanying description.

BRIEF DESCRIPTION OF THE DRAWINGS

FIG. 1 is a fragmentary perspective view of a golf ball retriever embodying the invention and shown holding a golf ball.

FIG. 2 is an enlarged cross-sectional view taken along the plane of lines 7–7.

FIG. 3 is an enlarged fragmentary view of the invention showing the invention holding a golf ball having the minimum regulation diameter.

FIG. 4 is an enlarged fragmentary view of the invention showing the invention holding a golf ball having a regulation diameter larger than the minimum regulation diameter.

DETAILED DESCRIPTION OF THE INVENTION

The device of the present invention could be described as a single loop multiple diameter golf ball retriever shown generally at 2 in FIG. 1. A stem 5 extends outwardly from loop 4 and is secured by any suitable means to any suitable extensible handle 18. Loop 4 is divided into three cylindrical sections having inner cylindrical surfaces 11, 12, and 13. The two outermost cylindrical surfaces 11 and 13 have diameters just slightly less than the diameter of the larger of the regulation diameter golf balls to be retrieved, or in this case about 1.710 inches. The centermost cylindrical surface 12 has a diameter just slightly less than the smaller of the regulation diameter golf balls to be retrieved, or about 1.670 inches. The gripping edges 16 of the cylindrical sections are to remain sharp as die cast or injection molded. The gripping edges 16 are to be formed in parallel planes and spaced about 0.150 inches apart so that the ball to be retrieved will only circumferentially contact the gripping edge designed for that particular size ball. The cast or molded sharp gripping edges 16 serve to better assure a gripping action when very light pressure is used to grip the golf ball.

At the present time there are only two USGA regulation golf ball sizes; 1.680 inch and 1.720 inch. Since the USGA imposes no limit to the maximum diameter of golf balls, it is possible that golf balls with larger diameters will be produced and gain acceptance by the USGA. While the invention has been shown and described as a loop 4 having cylindrical sections 11 and 13 with diameters slightly less than 1.720 inches and cylindrical section 12 with a diameter slightly less than 1.680 inches, additional cylindrical sections could be added for for retrieval of larger golf balls.

In operation the ring or loop 4 need only be extended through or over assorted hazards and barriers and touched down lightly on any regulation golf ball with either side of the loop, in order to firmly grip and retrieve the otherwise abandoned ball. In water the same light touch will suffice when the ball is lying on a solid surface. On any soft surface or when the ball diameter is below the surface on which it is found, the loop 4 may be slid beneath the ball to serve as a scoop or seat for lifting the ball.

While the basic embodiment of the invention has been shown and described, other modifications thereof are possible within the scope of the following claims.

What is claimed is:

1. A golf ball retriever having in combination:

(a) A handle;

(b) A loop, the inner peripheral surface of which is divided into three adjacent cylindrical surfaces, the centermost of said cylindrical surfaces having a diameter slightly less than 1.680 inches, the two outermost of said cylindrical surfaces having equal diameters of slightly less than 1.720 inches and equal heights of about 0.150 inches; and (c) A stem fixedly secured at one end thereof to an end of said handle and at an other end thereof to said loop.

2. A golf ball retriever of claim 1 wherein said centermost cylindrical surface has a diameter of about 1.670 inches.

3. A golf ball retriever of claim 2 wherein said two outermost cylindrical surfaces have diameters of about 1.710 inches.

* * * * *